US011434770B2

(12) United States Patent
Clum et al.

(10) Patent No.: US 11,434,770 B2
(45) Date of Patent: Sep. 6, 2022

(54) TIP COOLING DESIGN

(71) Applicant: United Technologies Corporation, Farmington, CT (US)

(72) Inventors: Carey Clum, East Hartford, CT (US); Ricardo Trindade, Mansfield, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 1159 days.

(21) Appl. No.: 15/471,731

(22) Filed: Mar. 28, 2017

(65) Prior Publication Data

US 2018/0283181 A1 Oct. 4, 2018

(51) Int. Cl.
*F01D 5/18* (2006.01)
*F01D 5/20* (2006.01)

(52) U.S. Cl.
CPC ..... *F01D 5/20* (2013.01); *F01D 5/187* (2013.01); *F05D 2240/307* (2013.01); *F05D 2260/221* (2013.01)

(58) Field of Classification Search
CPC . F01D 5/145; F01D 5/147; F01D 5/18; F01D 5/182; F01D 5/183; F01D 5/184; F01D 5/187; F01D 5/20; F05D 2240/307; F05D 2260/221; F05D 2260/2212; F05D 2260/2214; F05D 2260/22141
See application file for complete search history.

(56) References Cited

U.S. PATENT DOCUMENTS 6,179,556 B1 1/2001 Bunker
8,075,268 B1 * 12/2011 Liang ..... F01D 5/186 416/92
8,113,779 B1 * 2/2012 Liang ..... F01D 5/20 416/92

(Continued)

FOREIGN PATENT DOCUMENTS

DE 102015107844 A1 12/2015
EP 1895099 A2 3/2008

(Continued)

OTHER PUBLICATIONS

"Aerodynamic Tip Desensitization in Axial Flow Turbines"; The Pennsylvania State University, The Graduate School, Department of Aerospace Engineering, A Thesis in Aerospace Engineering by Debashis Dey, Dec. 2001, 149 pages.

(Continued)

*Primary Examiner* — Dominick L Plakkoottam
*Assistant Examiner* — Charles W Nichols
(74) *Attorney, Agent, or Firm* — Cantor Colburn LLP

(57) ABSTRACT

An airfoil has a pressure side wall and a suction side wall circumferentially spaced apart from the pressure side wall. Each radially extends between a root region and a tip region, and each axially extends between a leading edge and a trailing edge. The airfoil also has a gusset, a squealer pocket, and a tip pocket. The gusset extends between the pressure side wall and the suction side wall. The squealer pocket is formed in the tip region and is disposed between the leading edge, the gusset, the pressure side wall, and the suction side (Continued)

wall. The tip pocket is formed in the tip region and is spaced apart from the squealer pocket. The tip pocket is disposed between the trailing edge, the gusset, the pressure side wall, and the suction side wall.

11 Claims, 4 Drawing Sheets

(56) References Cited

U.S. PATENT DOCUMENTS

2004/0013515 A1 1/2004 Cherry et al.
2012/0051934 A1* 3/2012 Allen ..... C25D 7/10 416/229 R
2012/0201695 A1* 8/2012 Little ..... F01D 5/187 416/97 R
2013/0315749 A1* 11/2013 Zhang ..... F01D 5/20 416/97 R
2014/0178207 A1 6/2014 He et al.
2016/0017719 A1* 1/2016 Propheter-Hinckley ..... F01D 5/187 416/1
2016/0333698 A1* 11/2016 Weaver ..... C04B 35/83
2017/0122111 A1* 5/2017 Benson ..... F01D 5/188

FOREIGN PATENT DOCUMENTS

EP 2716870 A1 4/2014
EP 2942488 A1 11/2015
EP 3064714 A1 9/2016
EP 3118414 A1 1/2017

OTHER PUBLICATIONS

European Search Report from the European Patent Office for EP Application No. 18164750.4 dated Jun. 5, 2018, 7 pages.
EP Office Action for Application No. 18 164 750.4; dated Jan. 7, 2020.
EP OA for Application No. 18 164 750.4—dated Jun. 5, 2020.

* cited by examiner

TIP COOLING DESIGN

BACKGROUND

Illustrative embodiments pertain to the art of turbomachinery, and specifically to turbine rotor components.

Gas turbine engines are rotary-type combustion turbine engines built around a power core made up of a compressor, combustor and turbine, arranged in flow series with an upstream inlet and downstream exhaust. The compressor compresses air from the inlet, which is mixed with fuel in the combustor and ignited to generate hot combustion gas. The turbine extracts energy from the expanding combustion gas, and drives the compressor via a common shaft. Energy is delivered in the form of rotational energy in the shaft, reactive thrust from the exhaust, or both.

The individual compressor and turbine sections in each spool are subdivided into a number of stages, which are formed of alternating rows of blade and stator vane airfoils. The airfoils are shaped to turn, accelerate and compress the working fluid flow, or to generate lift for conversion to rotational energy in the turbine. The airfoils may be provided with passageways to provide internal cooling of the airfoils.

The airfoil tip may be a region that is sensitive to static pressure and may affect gas turbine engine performance as well as the internal cooling performance provided by the passageways. Clearance, abrasion and temperature effects are of concern proximate the tip region of the airfoil.

Accordingly it is desirable to provide an airfoil that maximizes the internal cooling performance provided by the passageways.

BRIEF DESCRIPTION

According to an embodiment of the present disclosure, an airfoil for a gas turbine engine is provided. The airfoil includes a pressure side wall, a suction side wall, a gusset, and a first pocket surface. The pressure side wall radially extends between a root region and a tip region. The suction side wall that is circumferentially spaced apart from the pressure side wall. The suction side wall radially extends between the root region and the tip region, and is joined to the pressure side wall at a leading edge and a trailing edge that is axially spaced apart from the leading edge. The gusset extends between the pressure side wall and the suction side wall. The first pocket surface is formed in the tip region and extends between the leading edge, the pressure side wall, the suction side wall, and the gusset. The first pocket surface, the pressure side wall, the suction side wall, and the gusset define a squealer pocket.

In addition to one or more of the features described above, or as an alternative to any of the foregoing embodiments, the pressure side wall has a first thickness proximate the leading edge and the suction side wall has a second thickness that differs from the first thickness proximate the leading edge.

In addition to one or more of the features described above, or as an alternative to any of the foregoing embodiments, the gusset has a third thickness that differs from the second thickness.

In addition to one or more of the features described above, or as an alternative to any of the foregoing embodiments, a second pocket surface formed in the tip region and extends between the trailing edge, the pressure side wall, the suction side wall, and the gusset.

In addition to one or more of the features described above, or as an alternative to any of the foregoing embodiments, the first pocket surface is disposed substantially parallel to but not coplanar with the second pocket surface.

In addition to one or more of the features described above, or as an alternative to any of the foregoing embodiments, the second pocket surface, the pressure side wall, the suction side wall, and the gusset define a tip pocket.

In addition to one or more of the features described above, or as an alternative to any of the foregoing embodiments, the gusset is disposed between the squealer pocket and the tip pocket.

In addition to one or more of the features described above, or as an alternative to any of the foregoing embodiments, the airfoil defines a first suction side hybrid skin core cavity that radially extends through the first pocket surface and is disposed proximate the suction side wall and the gusset.

In addition to one or more of the features described above, or as an alternative to any of the foregoing embodiments, the airfoil defines a first pressure side hybrid skin core cavity that radially extends through the first pocket surface and is disposed proximate the leading edge, the pressure side wall, and the gusset.

According to an embodiment of the present disclosure, a turbine section of a gas turbine engine is provided. The turbine section includes an airfoil and a blade outer air seal. The airfoil has a pressure side wall and a suction side wall circumferentially spaced apart from the pressure side wall. Each radially extends between a root region and a tip region, and each axially extends between a leading edge and a trailing edge. The airfoil also has a gusset, a squealer pocket, and a tip pocket. The gusset extends between the pressure side wall and the suction side wall. The squealer pocket is formed in the tip region and is disposed between the leading edge, the gusset, the pressure side wall, and the suction side wall. The tip pocket is formed in the tip region and is spaced apart from the squealer pocket. The tip pocket is disposed between the trailing edge, the gusset, the pressure side wall, and the suction side wall. The blade outer air seal disposed about the airfoil.

In addition to one or more of the features described above, or as an alternative to any of the foregoing embodiments, the airfoil includes a tip surface that is disposed proximate the tip region and extending between the pressure side wall, the suction side wall, the leading edge, and the trailing edge.

In addition to one or more of the features described above, or as an alternative to any of the foregoing embodiments, the squealer pocket extends from the tip surface towards a first pocket surface.

In addition to one or more of the features described above, or as an alternative to any of the foregoing embodiments, the tip pocket extends from the tip surface towards a second pocket surface that is separated from the first pocket surface by the gusset.

In addition to one or more of the features described above, or as an alternative to any of the foregoing embodiments, the airfoil defines a first suction side hybrid skin core cavity and a first pressure side hybrid skin core cavity that radially extends into the squealer pocket and each are disposed proximate the leading edge, the pressure side wall, the suction side wall, and the gusset.

In addition to one or more of the features described above, or as an alternative to any of the foregoing embodiments, a first radial distance is defined between the tip surface and the blade outer air seal.

In addition to one or more of the features described above, or as an alternative to any of the foregoing embodiments, a second radial distance is defined between the tip surface and the first pocket surface.

In addition to one or more of the features described above, or as an alternative to any of the foregoing embodiments, a ratio between the first radial distance and the second radial distance is greater than 2.

In addition to one or more of the features described above, or as an alternative to any of the foregoing embodiments, the second radial distance is greater than the first radial distance.

In addition to one or more of the features described above, or as an alternative to any of the foregoing embodiments, at least one of the pressure side wall and the suction side wall includes an inner surface that is angled towards the other of the at least one of the pressure side wall and the suction side wall in a direction that extends from the first pocket surface towards the tip surface.

In addition to one or more of the features described above, or as an alternative to any of the foregoing embodiments, the pressure side wall has a first thickness proximate the leading edge and the suction side wall has a second thickness that differs from the first thickness proximate the leading edge.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
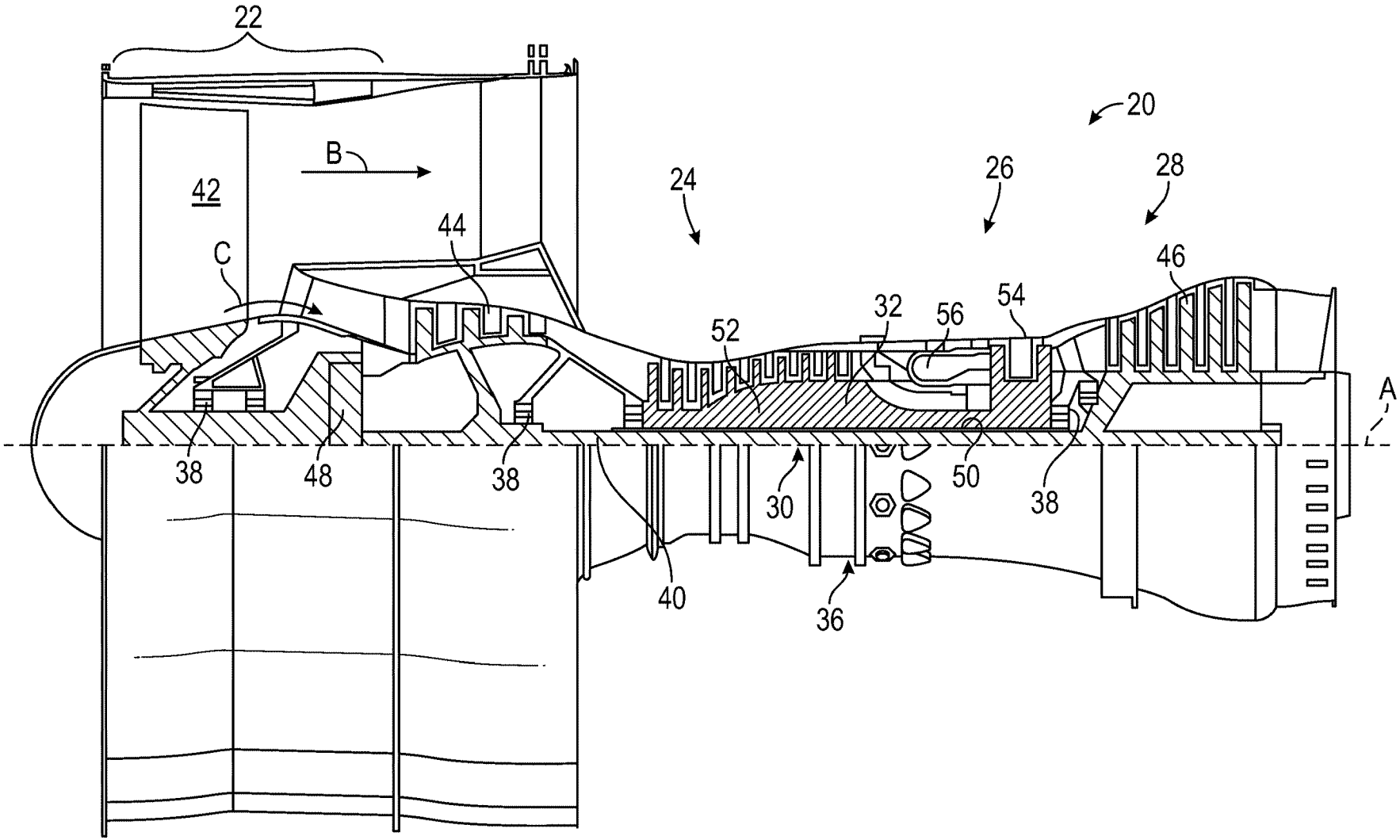
FIG. 1 is a schematic cross-sectional illustration of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in the gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in the gas turbine engine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only illustrative of one embodiment of a geared architecture engine and that the present disclosure is applicable to other gas turbine engines including direct drive turbofans.

Although the gas turbine engine 20 is depicted as a turbofan, it should be understood that the concepts described herein are not limited to use with the described configuration, as the teachings may be applied to other types of engines such as, but not limited to, turbojets, turboshafts, and three-spool (plus fan) turbofans wherein an intermediate spool includes an intermediate pressure compressor ("IPC") between a low pressure compressor ("LPC") and a high pressure compressor ("HPC"), and an intermediate pressure turbine ("IPT") between the high pressure turbine ("HPT") and the low pressure turbine ("LPT").

Figure 2:
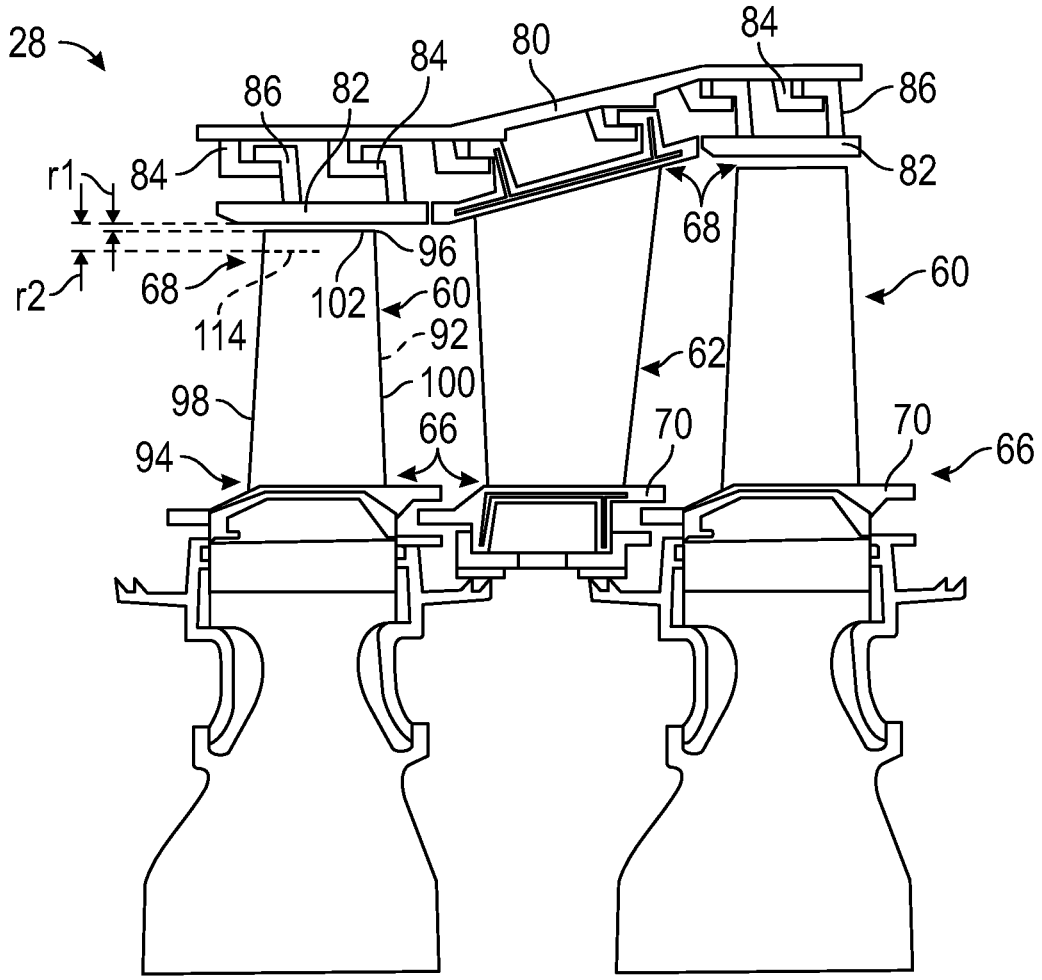
FIG. 2 is a schematic illustration of a portion of a turbine section of the gas turbine engine of FIG. 1.

FIG. 2 is a schematic view of a portion of the turbine section 28 that may employ various embodiments disclosed herein. Turbine section 28 includes a plurality of airfoils 60, 62 including, for example, one or more blades and vanes. The airfoils 60, 62 may be hollow bodies with internal cavities defining a number of channels or cores, hereinafter airfoil cores, formed therein and extending from an inner diameter 66 to an outer diameter 68, or vice-versa. The airfoil cores may be separated by partitions within the airfoils 60, 62 that may extend either from the inner diameter 66 or the outer diameter 68 of the airfoil 60, 62. The partitions may extend for a portion of the length of the airfoil 60, 62, but may stop or end prior to forming a complete wall within the airfoil 60, 62. Thus, each of the airfoil cores may be fluidly connected and form a fluid path within the respective airfoil 60, 62. The airfoils 60, 62 may include platforms 70 located proximal to the inner diameter 66 thereof. Located below the platforms 70 (e.g., radially inward with respect to the engine axis) may be airflow ports and/or bleed orifices that enable air to bleed from the internal cavities of the airfoils 60, 62. A root of the airfoil may connected to or be part of the platform 70.

The turbine section 28 is housed within a case 80, which may have multiple parts (e.g., turbine case, diffuser case, etc.). In various locations, components, such as seals, may be positioned between airfoils 60, 62 and the case 80. For example, as shown in FIG. 2, a blade outer air seals 82 (hereafter "BOAS") are located radially outward from the airfoil 60. As will be appreciated by those of skill in the art, the BOAS 82 may include BOAS supports that are configured to fixedly connect or attach the BOAS 82 to the case 80 (e.g., the BOAS supports may be located between the BOAS 82 and the case 80). As shown in FIG. 2, the case 80 includes a plurality of case hooks 84 that engage with BOAS hooks 86 to secure the BOAS 82 between the case 80 and a tip of the airfoil 60.

Figure 3:
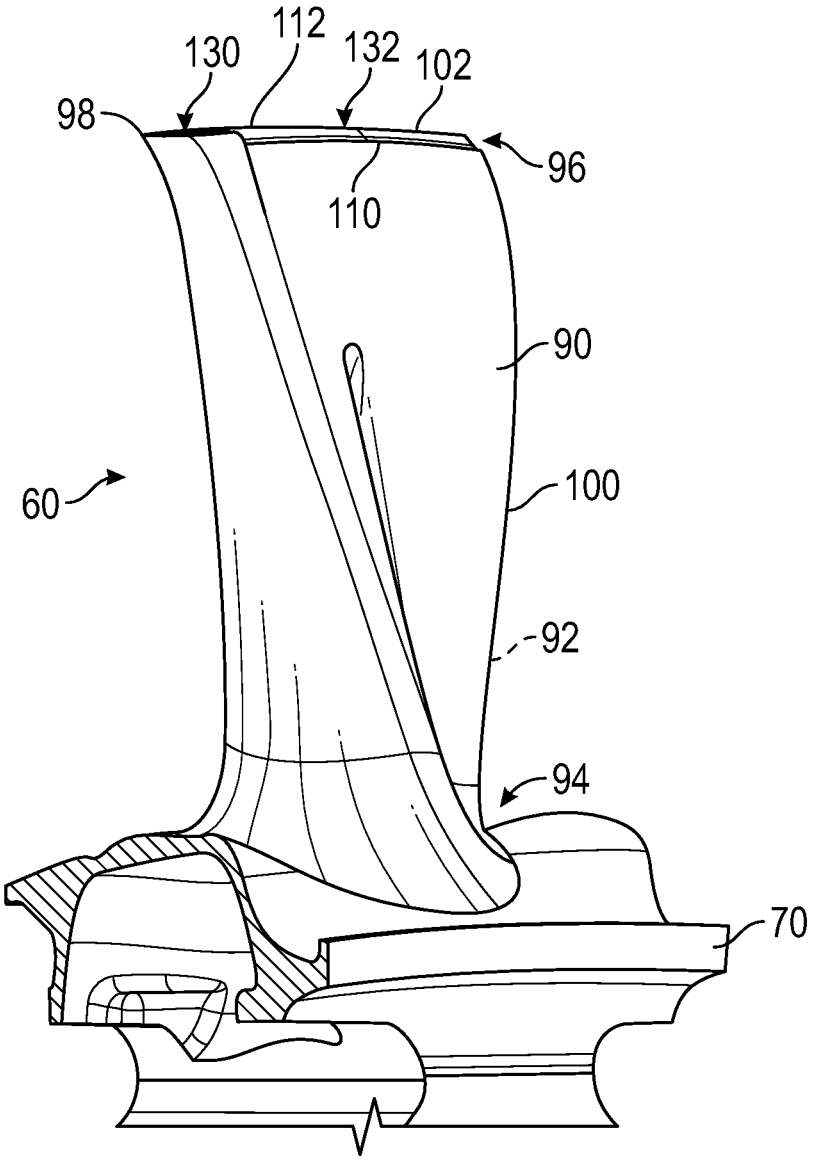
FIG. 3 is a perspective view of an airfoil.

As shown in FIGS. 2 and 3, the airfoil 60 includes a pressure side wall 90, a suction side wall 92, a root region 94, a tip region 96, a leading edge 98, a trailing edge 100, and a tip surface 102. A direction that extends from the pressure side wall 90 towards the suction side wall 92 is a circumferential direction. A direction that extends from the root region 94 towards the tip region 96 is a radial direction relative to the engine central longitudinal axis A shown in FIG. 1. A direction that extends from the leading edge 98 to the trailing edge 100 is an axial direction relative to the engine central longitudinal axis A shown in FIG. 1.

The pressure side wall 90 is disposed opposite and is circumferentially spaced apart from the suction side wall 92. The pressure side wall 90 and the suction side wall 92 each extend radially between the root region 94 toward the tip region 96. The pressure side wall 90 and the suction side wall 92 each extend axially and/or tangentially between leading edge 98 and the trailing edge 100 that is axially spaced apart from the leading edge 98. The pressure side wall 90 is joined to the suction side wall 92 at the leading edge 98 and at the trailing edge 100. The pressure side wall 90 has a first thickness, t1, proximate the tip region 96 and proximate the leading edge 98. The suction side wall 92 has a second thickness, t2, proximate the tip region and proximate the leading edge that differs from the first thickness, t1. The second thickness, t2, is greater than the first thickness, t1. The second thickness, t2, of the suction side wall 92 makes the airfoil 60 more robust against impacts or oxidation.

Each of the root region 94 and the tip region 96 extend from the leading edge 98 to the trailing edge 100 opposite each other. That is, the root region 94 defines an inner radial end or inner diameter 66 of the airfoil 60 and the tip region 96 defines an outer radial end or outer diameter 68 of the airfoil 60 (relative to an engine axis).

The tip surface 102 is disposed proximate the tip region 96. The tip surface 102 extends between the pressure side wall 90, the suction side wall 92, the leading edge 98, and the trailing edge 100. A first radial distance, r1, is defined between the tip surface 102 and the blade outer air seal 82, as shown in FIG. 2.

Figure 4:
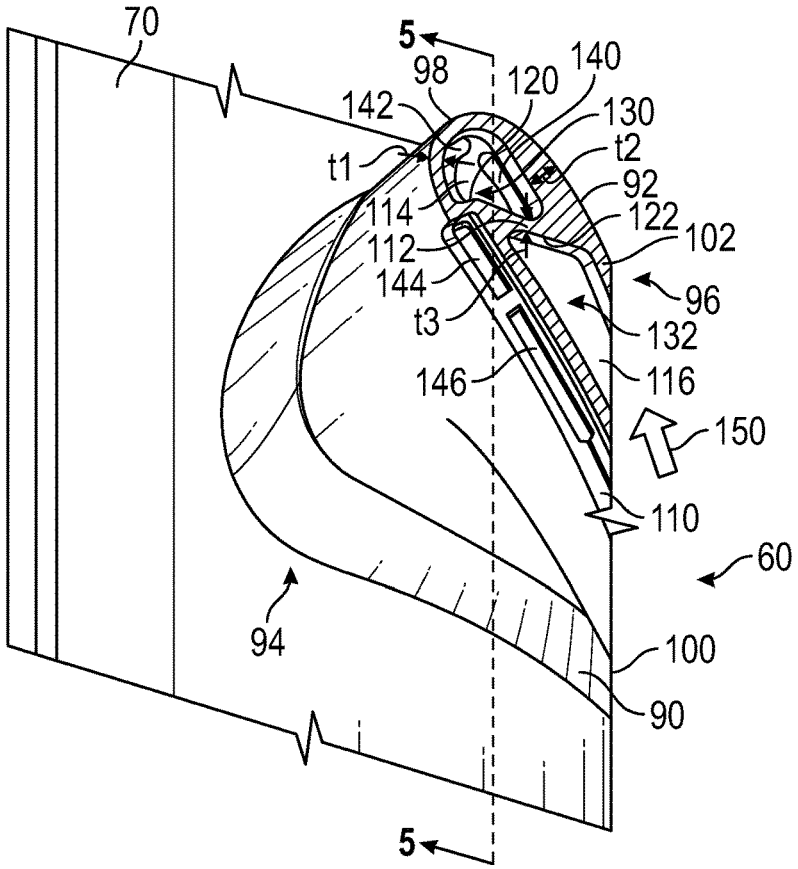
FIG. 4 is a partial top perspective view of the airfoil.

Referring to FIGS. 3 and 4, the airfoil 60 includes a tip shelf 110, a gusset 112, a first pocket surface 114, and a second pocket surface 116.

The tip shelf 110 is radially recessed within the tip region 96. The tip shelf 110 is axially spaced apart from the leading edge 98 and extends towards the trailing edge 100. The tip shelf 110 is disposed substantially parallel to but not coplanar with the tip surface 102. The tip shelf 110 circumferentially extends from the pressure side wall 90 towards the suction side wall 92 but is circumferentially spaced apart from the suction side wall 92.

The gusset 112 extends between the pressure side wall 90 and the suction side wall 92. The gusset 112 is angled towards the trailing edge 100 in a direction that extends from the pressure side wall 90 towards the suction side wall 92. The gusset 112 has a third thickness, t3, that is measured between a first side 120 of the gusset 112 and a second side of the gusset 112 proximate the tip region 96. The third thickness, t3, differs from the second thickness, t2. The third thickness, t3, is less than the second thickness, t2. The third thickness, t3, is greater than the first thickness, t1.

The first pocket surface 114 is radially recessed within the tip region 96. The first pocket surface 114 circumferentially extends between an inner surface of the pressure side wall 90 and an inner surface of the suction side wall 92. The first pocket surface 114 axially extends between an inner surface of the leading edge 98 towards the first side 120 of the gusset 112. The first pocket surface 114 is disposed substantially parallel to but not coplanar with the tip surface 102. A second radial distance, r2, is defined between the first pocket surface 114 and the blade outer air seal 82. The second radial distance, r2, is greater than the first radial distance, r1. A ratio between the first radial distance, r1, and the second radial distance, r2, is greater than approximately 2. In at least one embodiment, a ratio between the first radial distance, r1, and the second radial distance, r2, is greater than approximately 1.

Figure 5:
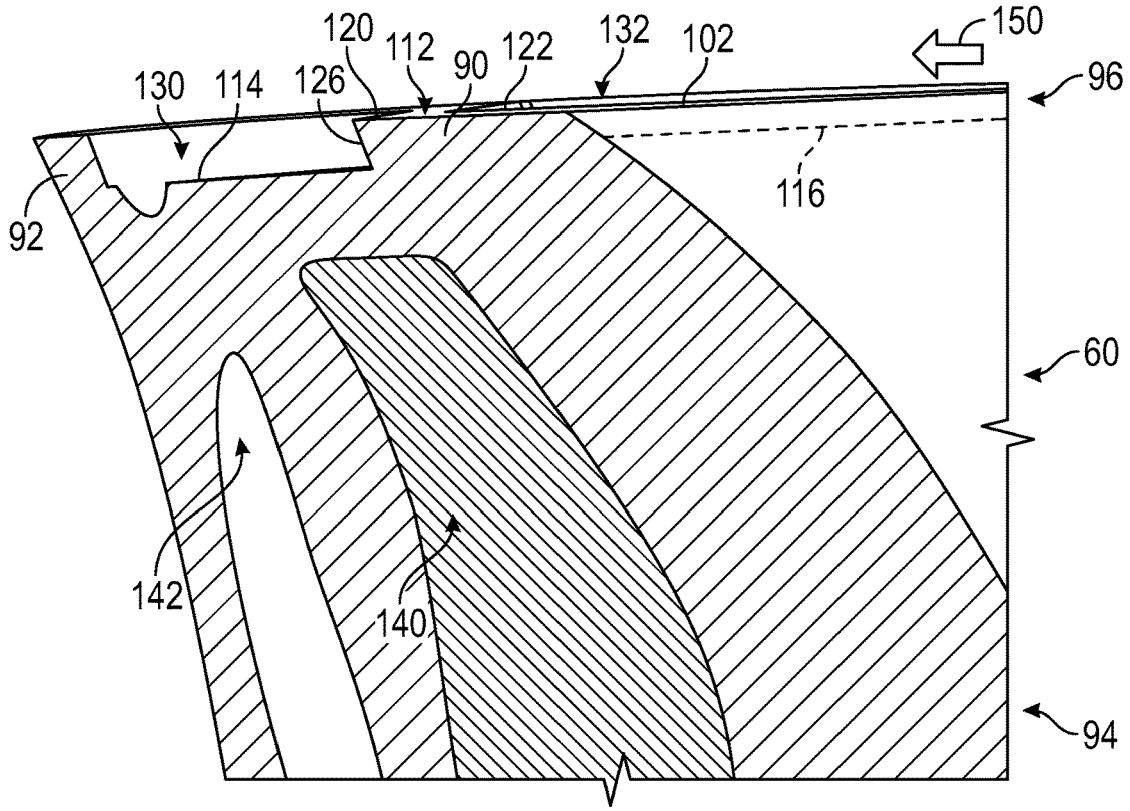
FIG. 5 is a partial side perspective view of a tip region of the airfoil.

As shown in FIG. 5, at least one of the pressure side wall 90 and the suction side wall 92 includes an inner surface 126. The inner surface 126 is angled towards the other of the at least one of the pressure side wall 90 and the suction side wall 92 in a direction that extends from the first pocket surface 114 towards the tip surface 102.

Referring to FIGS. 4 and 5, a squealer pocket 130 is formed within and is radially recessed within the tip region 96. The squealer pocket 130 extends from the tip surface 102 towards the first pocket surface 114. The squealer pocket 130 is defined by or disposed between the pressure side wall 90, the suction side wall 92, the leading edge 98, the first side 120 of the gusset 112, and the first pocket surface 114. The squealer pocket 130 is disposed proximate the leading edge 98 within the tip region 96.

The second pocket surface 116 is radially recessed within the tip region 96 and is spaced apart from or separated from the first pocket surface 114 by the gusset 112. The second pocket surface 116 circumferentially extends between an inner surface of the pressure side wall 90 and an inner surface of the suction side wall 92. The second pocket surface 116 axially extends between the second side 122 of the gusset 112 towards the trailing edge 100. The second pocket surface 116 is disposed substantially parallel to but may not be disposed coplanar with the tip surface 102 and the first pocket surface 114.

A tip pocket 132 is formed within and is radially recessed within the tip region 96. The tip pocket 132 extends from the tip surface 102 towards the second pocket surface 116. The tip pocket 132 is spaced apart from or separated from the squealer pocket 130 by the gusset 112 such that the gusset 112 is disposed between the squealer pocket 130 and the tip pocket 132. The tip pocket 132 is defined by or disposed between the pressure side wall 90, the suction side wall 92, the trailing edge 100, the second side 122 of the gusset 112, and the second pocket surface 116. The tip pocket 132 is spaced apart from the leading edge 98.

The airfoil 60 defines or includes a plurality of cavities to enable cooling flow to flow through the airfoil 60. The airfoil includes a first suction side hybrid skin core cavity 140, a first pressure side hybrid skin core cavity 142, a second pressure side hybrid skin core cavity 144, and a third pressure side hybrid skin core cavity 146.

The hybrid skin core cavities are cooling passages or cooling cavities that are disposed immediately adjacent to a hot wall. The hybrid skin core cavities are hollow cooling passages or cavities that are created by a solid ceramic core, a refractory metal core, or the like. The core is leached out of the metal casting airfoil geometry leaving a hollow void or cooling cavity passage that may contain internal heat transfer augmentation features such as trip strips, turbulators, pedestals, pin fins, or the like. The resulting hybrid skin core cavity is positioned immediately adjacent to and is in close proximity to an external hot wall to provide cooling, e.g. the pressure side wall 90 and the suction side wall 92. The hybrid skin core cavity provides localized cooling to a single hot wall of the airfoil 60.

The term "hybrid" in the context of the present disclosure refers to cavities that may contain internal heat transfer augmentation features near or immediately adjacent to a hot wall surface. The term "hybrid" also refers to providing cooling in local proximity to where the internal heat transfer augmentation feature is located.

The term "skin" in the context of the present disclosure refers to an external hot surface or wall of the airfoil (e.g. the pressure side wall 90 and the suction side wall 92). The external hot surface of wall of the airfoil may be arranged close to or proximate an external heat source, i.e. the hot gas path surface.

The hybrid skin core cavities have a low aspect ratio. In some embodiments, a hybrid skin core cavity may have a height to width ratio of less than about 0.8, as shown in FIG. 4, while conventional height to width ratios that are greater than about 0.8. As used with respect to the described ratio, a "height" of a cavity is a distance from an outer wall of the airfoil that partially defines the cavity to an inner wall that is internal to the airfoil. Further, a width of a cavity is a dimension or length along one of the walls or surfaces that defines the height dimension.

The first suction side hybrid skin core cavity 140 extends radially from the root region 94 towards the tip region 96. The first suction side hybrid skin core cavity 140 is located proximate the leading edge 98, the suction side wall 92, and the first side 120 of the gusset 112. The first suction side hybrid skin core cavity 140 radially extends through the first pocket surface 114.

The first pressure side hybrid skin core cavity 142 extends radially from the root region 94 towards the tip region 96. The first pressure side hybrid skin core cavity 142 is spaced apart from the first suction side hybrid skin core cavity 140. The first pressure side hybrid skin core cavity 142 is located proximate the leading edge 98, the pressure side wall 90, and the first side of the gusset 112. The first pressure side hybrid skin core cavity 142 radially extends through the first pocket surface 114.

The second pressure side hybrid skin core cavity 144 and the third pressure side hybrid skin core cavity 146 are spaced apart from the leading edge 98 and extend radially from the root region 94 towards the tip region 96. The second pressure side hybrid skin core cavity 144 is spaced apart from the third pressure side hybrid skin core cavity 146. The second pressure side hybrid skin core cavity 144 is disposed closer to the leading edge 98 than the third pressure side hybrid skin core cavity 146. The second pressure side hybrid skin core cavity 144 is separated from the first pressure side hybrid skin core cavity 142 by the gusset 112. The second pressure side hybrid skin core cavity 144 and the third pressure side hybrid skin core cavity 146 extend radially through the tip shelf 110.

As airflow 150, crosses over the tip surface 102 proximate the tip region 96, the airflow 150 sees a step change in area as it passes over the squealer pocket 130. The inner surface 126 angled towards at least one of the pressure side wall 90 and the suction side wall 92 provides a sharp transition that creates a separation region to bring the static pressure closer to a total pressure. This sharp transition coupled with the increased cross-sectional area of the squealer pocket 130 reduces the Mach number of the airflow 150 making the static pressure more stable.

Furthermore, as cooling air flows through the first suction side hybrid skin core cavity 140 and the first pressure side hybrid skin core cavity 142 and crosses over the first pocket surface 114, the cooling air sees a step change in area due to the cross-sectional area of the squealer pocket 130. The step change reduces the sensitivity of cooling air flow through the hybrid skin core cavities by pushing the static pressure closer to the total pressure. As such the ratio between the first radial distance, r1, and the cross-sectional area of the squealer pocket 130 cause the Mach number of the airflow 152 reduce and the static pressure in the total pressure to converge to improve cooling performance points of the airfoil 60.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An airfoil for a gas turbine engine, comprising:

a pressure side wall radially extending between a root region and a tip region;

a suction side wall that is circumferentially spaced apart from the pressure side wall, radially extending between the root region and the tip region, and joined to the pressure side wall at a leading edge and a trailing edge that is axially spaced apart from the leading edge;

a gusset extending between the pressure side wall and the suction side wall;

a first pocket surface formed in the tip region and extending between the leading edge, the pressure side wall, the suction side wall, and the gusset, the first pocket surface, the pressure side wall, the suction side wall, and the gusset define a squealer pocket;

a first suction side hybrid skin core cavity defined by the airfoil that radially extends through the first pocket surface and is abutting the suction side wall and the gusset and spaced from the pressure side wall;

a first pressure side hybrid skin core cavity defined by the airfoil that radially extends through the first pocket surface and is abutting to the leading edge, the pressure side wall, and the gusset and spaced from the suction side wall; and the airfoil defining a tip shelf recessed within the tip region abutting the pressure side wall and extended along the pressure side wall from the trailing edge toward the leading edge and spaced from the leading edge, the squealer pocket, and the tip pocket.

2. The airfoil of claim 1, wherein the pressure side wall has a first thickness proximate the leading edge and the suction side wall has a second thickness that differs from the first thickness proximate the leading edge.

3. The airfoil of claim 2, wherein the gusset has a third thickness that differs from the second thickness.

4. The airfoil of claim 1, further comprising:

a second pocket surface formed in the tip region and extends between the trailing edge, the pressure side wall, the suction side wall, and the gusset.

5. The airfoil of claim 4, wherein the first pocket surface is disposed substantially parallel to but not coplanar with the second pocket surface.

6. The airfoil of claim 4, wherein the second pocket surface, the pressure side wall, the suction side wall, and the gusset define a tip pocket.

7. The airfoil of claim 6, wherein the gusset is disposed between the squealer pocket and the tip pocket.

8. An airfoil for a gas turbine engine, comprising:

a pressure side wall extending in a radial direction with respect to the gas turbine engine between a root region and a tip region;

a suction side wall that is spaced apart in a circumferential direction with respect to the gas turbine engine from the pressure side wall, extending in the radial direction between the root region and the tip region, and joined to the pressure side wall at a leading edge and a trailing edge that is spaced in an axial direction with respect to the gas turbine engine apart from the leading edge;

a gusset extending between the pressure side wall and the suction side wall;

a first pocket surface formed in the tip region and extending between the leading edge, the pressure side wall, the suction side wall, and the gusset, the first pocket surface, the pressure side wall, the suction side wall, and the gusset define a squealer pocket;

a first suction side hybrid skin core cavity defined by the airfoil that extends in the radial direction through the first pocket surface and is abutting the suction side wall and the gusset and spaced from the pressure side wall;

a first pressure side hybrid skin core cavity defined by the airfoil that extends in the radial direction through the first pocket surface and is abutting the leading edge, the pressure side wall, and the gusset and spaced from the suction side wall;

a second pocket surface formed in the tip region and extends between the trailing edge, the pressure side wall, the suction side wall, and the gusset, the second pocket surface, the pressure side wall, the suction side wall, and the gusset define a tip pocket; and the airfoil defining a tip shelf recessed within the tip region abutting the pressure side wall extended along the pressure side wall from the trailing edge toward the leading edge and spaced from the leading edge, the squealer pocket, and the tip pocket.

9. The airfoil of claim 8, wherein the airfoil defines a second pressure side hybrid skin core cavity that extends in the radial direction through the tip shelf.

10. The airfoil of claim 9, wherein the airfoil defines a third pressure side hybrid skin core cavity that extends in the radial direction through the tip shelf that is spaced from the second pressure side hybrid skin core cavity and tapers toward the trailing edge.

11. The airfoil of claim 8, wherein the tip shelf extends long the pressure side wall further with respect to the trailing edge and the pressure side wall than the tip pocket and the squealer pocket extends toward the trailing edge and overlaps the tip shelf with respect to the circumferential direction.

* * * * *